United States Patent [19]

Stetson et al.

[11] 3,978,251

[45] Aug. 31, 1976

[54] ALUMINIDE COATINGS

[75] Inventors: Alvin R. Stetson, San Diego; Victor S. Moore, El Cajon, both of Calif.

[73] Assignee: International Harvester Company, San Diego, Calif.

[22] Filed: June 14, 1974

[21] Appl. No.: 479,419

[52] U.S. Cl. ..... 427/229; 427/253; 427/405; 29/197

[51] Int. Cl.[2] ..... C23C 9/02

[58] Field of Search ..... 427/252, 253, 405, 191, 427/229

[56] References Cited

UNITED STATES PATENTS

| | | | |
|---|---|---|---|
| 3,477,831 | 11/1969 | Talboom, Jr. et al. | 427/252 X |
| 3,594,219 | 7/1971 | Maxwell | 427/252 X |
| 3,598,638 | 8/1971 | Levine | 427/253 X |
| 3,640,755 | 2/1972 | Barth | 427/405 |
| 3,640,815 | 2/1972 | Schwartz et al. | 427/252 X |
| 3,711,315 | 1/1973 | Brill-Edwards | 427/192 |
| 3,716,398 | 2/1973 | Stueber et al. | 427/253 X |
| 3,761,301 | 9/1973 | Sama et al. | 427/405 X |
| 3,764,279 | 10/1973 | Kmieciak et al. | 427/253 X |

*Primary Examiner*—Ralph S. Kendall

*Attorney, Agent, or Firm*—Strauch, Nolan, Neale, Nies & Kurz

[57] ABSTRACT

Protecting superalloys with coatings of intermetallic compounds of aluminum which are essentially free of elements or compounds from the substrate that are deleterious to hot corrosion and sulfidation or oxidation resistance.

24 Claims, 5 Drawing Figures

ALUMINIDE COATINGS

Figure 1:
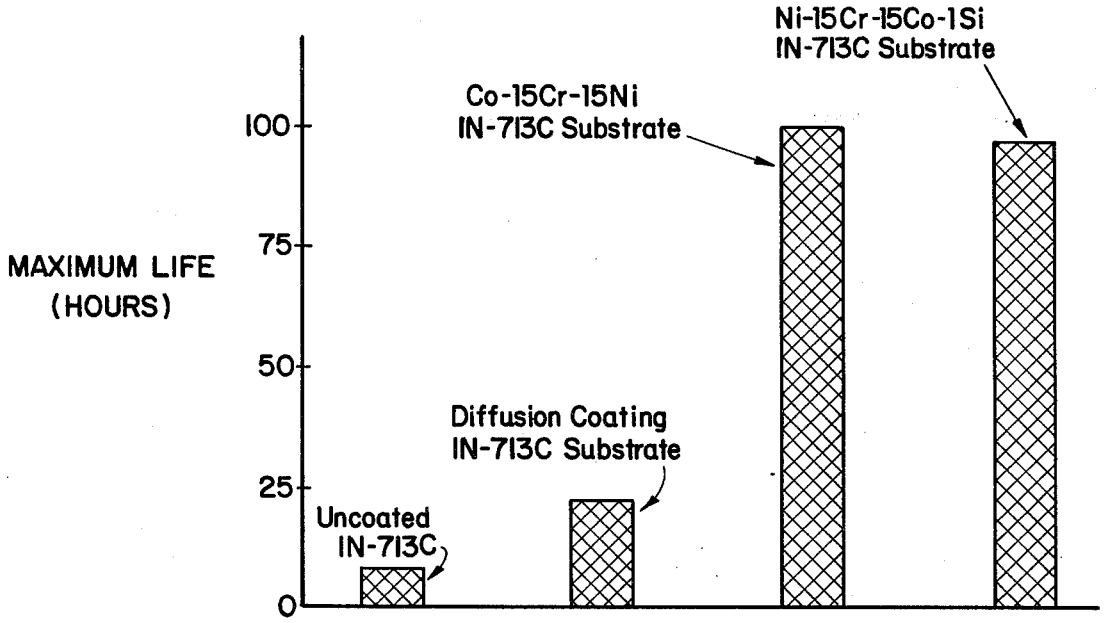

This invention relates to coatings and, more particularly, to novel improved coatings for protecting superalloys against corrosion and/or oxidation and sulfidation, especially at high temperatures.

Superalloys are strong at high temperatures and find particular utility in very demanding applications such as gas turbine engines. The compositions of representative superalloys are shown in the following table.

TABLE I

| | Nominal Wt. % | | | | | | | | | | | | | |
|---|---|---|---|---|---|---|---|---|---|---|---|---|---|---|
| Alloy | Ni | Co | Cr | Mo | W | Ta | Cb | Ti | Al | C | B | Zr | Re | Hf |
| IN-713C | Bal | — | 12.5 | 4.2 | — | — | 2.0 | 0.8 | 6.1 | 0.12 | 0.01 | 0.1 | — | — |
| IN-738 | Bal | 8.5 | 16.0 | 1.75 | 2.6 | 1.75 | 0.9 | 3.4 | 3.4 | 0.17 | 0.01 | 0.1 | — | — |
| B1900 | Bal | 10 | 8.0 | 6.0 | — | 4.3 | — | 1.0 | 6.0 | 0.11 | 0.01 | 0.08 | — | — |
| NASA-TRW-VIA | Bal | 7.5 | 6.1 | 2.0 | 5.8 | 9.0 | 0.5 | 1.0 | 5.4 | 0.13 | 0.02 | 0.13 | 0.5 | 0.43 |
| MAR-M509 | 10 | Bal | 24 | — | 7 | 3.5 | — | 0.2 | — | 0.6 | — | — | — | — |

The trend in nickel-based superalloys used for gas turbines components requiring very high strength such as blades and turbines nozzles is toward a declining chromium content. This permits the amount of higher strength refractory metals such as molybdenum, tantalum, columbium, and tungsten to be increased. However, the lowered chromium content results in poor hot corrosion resistance as does the increase in the refractory metal content.

Other recent nickel-based superalloys have a high chromium content but contain significant amounts of titanium. These alloys exhibit improved hot corrosion resistance but poor resistance to oxidation.

Hot corrosion resistance of these alloys remains inadequate, however. For example, IN–738 (see Table I) is one of the recent alloys of this character. Turbine engine blades made from this alloy can fail from hot corrosion at temperatures as low as 1450° F. in less than 500 hours in marine environments, in certain desert areas around the world, and in other applications in which salts are ingested into the engine and in which the fuel sulfur content is above about 0.01 percent.

The marine environment is one of the most severe to which a gas turbine can be subjected. Aerosols containing salt water are ingested into the engine and are at least in part converted to alkali sulfates. These deposit on blade and vane surfaces, disrupting the normal protective oxides. These sulfur-containing compounds convert elements in the substrate (particularly chromium) to sulfides, depleting the alloy in one or more elements critical to the development of a protective surface oxide.

The chromium content of cobalt-based superalloys has remained high. Even at that, however, the oxidation resistance of these alloys is only fair at temperatures above 1700°F. Thus, they too are subject to failure in demanding applications.

Aluminide coatings have been the typical approach to improving the oxidation, sulfidation, and hot corrosion resistance of superalloys in gas turbines and other demanding applications.

U.S. Pat. No. 2,927,043 issued Mar. 1, 1960, to Stetson discloses a process of forming an aluminide coating in which powdered aluminum or an aluminum alloy (usually dispersed in a flux carrier) is fused onto the surface of the part at a temperature below 1500°F. The flux is then removed and the aluminum or alloy diffused into the substrate. The resulting coating is, basically, an aluminide of the substrate.

Other representative processes for producing aluminide coatings are disclosed in U.S. Pat. Nos. 3,477,831 issued Nov. 11, 1969, to Talboom; 3,462,820 issued Aug. 26, 1969, to Maxwell; 3,493,476 issued Feb. 3, 1970, to Lucas; 3,257,230 issued June 21, 1966, to Wachtell; 3,647,517 issued Mar. 7, 1972, to Milidantri; 3,338,783 issued Aug. 29, 1967, to Rowady; 3,198,610 issued Aug. 3, 1965, to Whitfield; and 3,290,126 issued Dec. 6, 1966, to Monson.

A more recent process for producing aluminide coatings on superalloys is disclosed in U.S. Pat. No. 3,415,672 issued Dec. 10, 1968, to Levinstein. In it titanium and aluminum are codeposited on the substrate at a temperature ranging up to 2150°F., developing an alloy significantly more oxidation and hot corrosion resistant than the substrate.

One limitation which processes such as those disclosed in the Stetson and Levinstein patents have is that significant amounts of substrate alloy elements are incorporated in the coatings. Thus, if the substrate contains tungsten, molybdenum, tantalum, titanium, or columbium, these elements are found within the coating. Because these elements adversely influence hot corrosion and/or oxidation resistance, maximum performance of the coating is not attained.

Even quite small quantities of elements such as molybdenum and/or tungsten can significantly decrease the hot corrosion resistance of the coating because they form low melting point phases which disrupt the protective oxide coatings that would otherwise be present. Titanium adversely affects hot corrosion resistance by different phenomena and is not a serious problem unless relatively large amounts are present.

There is a need for coatings generally free of the elements known to inhibit the performance of aluminide coatings in oxidation or hot corrosion environments. Such coatings have until this time been difficult to apply and usually very expensive.

U.S. Pat. No. 3,676,085 issued July 11, 1972, to Evans et al. discloses a cobalt-chromium-aluminum-yttrium composition applied by electron beam vaporization. This coating has many of the features which result in hot corrosion and oxidation resistance.

However, the cost of applying an aluminide coating by the Evans et al electron beam vaporization technique is 20 to 60 times as high as the cost of making a coating by the Levinstein process, for example.

In the Evans et al. process, ingots of the Co-Cr-Al-Y alloy must be fabricated and machined to dimension. These ingots are then introduced into an electron beam vaporizer at a high vacuum and vaporized. Also, the parts must be preheated to a high temperature to ensure adequate metallurgical bonding.

The Evans et al process also produces large amounts of unrecoverable alloy as the metal vaporizes essentially in a 180°arc, and deposition occurs only on a very small percentage of this arc (usually between 30°and 60°).

The equipment needed for the Evans et al. process is extremely expensive (approximately 10 to 20 times the cost of the facilities needed for the Levinstein and other typical pack aluminizing processes). Required are electron beam melting equipment, vacuum chambers, remote handling equipment, remote heating equipment, and aids for preventing deposition of the coating on certain areas of components.

Also, the Evans et al. process is limited to coating relatively simple configurations because it is a line-of-sight process. For example, it cannot be used as a practical matter to coat multiple vane segments or the shrouds of vanes and blades because of the manipulations that would have to be made inside the vacuum chamber during the deposition cycle.

Furthermore, the Evans et al. Co-Cr-Al-Y coating is designed for moderate ductility at temperatures as low as 300°to 400°F. To attain this ductility, the aluminum content is kept at 15 percent or less. Even with the high chromium content and addition of yttrium, this can result in a significant sacrifice of useful service life in oxidizing and hot corrosion environments.

We have now invented a novel process for producing, on superalloys, aluminide (or aluminum intermetallic) coatings which are superior to those produced by the Levinstein process in that they are free of constituents which adversely effect hot corrosion resistance. They are equal or superior to coatings produced by the Evans process, yet are typically 15–40 times less expensive.

In our novel process, the article to be protected is coated with powdered metallic elements. Aluminum pack cementation is then employed to knit the elements together, to eliminate porosity, and to metallurgically bond the overlay to the substrate.

We employ aluminum free, nickel- and cobalt-based modifiers in the initial step of our process. The term "modifier" is employed herein to designate a mixture of powdered metals (particle size $<43\mu m$) capable of reacting with aluminum to form intermetallic or aluminides.

The modifier is mixed with an organic vehicle and a binder/suspending agent to form a slurry. The binder/-suspending agent is employed to ensure that the metallic particles remain uniformly dispersed in the liquid vehicle until and while the composition is applied. It also fixes the particles to the superalloy substrate, keeping them uniformly distributed over the substrate surface during subsequent handling and processing (separate materials can of course be used to perform these two functions, if desired).

The slurry is applied to a precleaned superalloy substrate by dipping, spraying, brushing, etc. to a thickness of 0.002 to 0.005 inch in an amount of from 15 to 35 milligrams per square centimeter of substrate surface (the substrate can be precleaned by alkaline or vapor degreasing and light sandblasting with 80 to 120 grit aluminum oxide). The slurry is air dried at 70° to 100°F. to form a bisque on the substrate.

The bisque can be sintered at 1800° to 2100°F. in an inert gas or in a high vacuum ($<10^{-4}$ Torr) before further processing of the article, if desired. However, the preferred procedure is to introduce the artifact with the bisque unsintered into an aluminizing pack of the aluminum-chromium type and heat it at a temperature of 2000° to 2100°F. for 6 to 40 hours. In this aluminizing cycle the elements in the modifier are converted to compounds of the formula $\beta$-MAl (M is cobalt or nickel with some chromium and other elements).

The term "reaction sintering" has been selected to identify the processes occurring within the modifier as a result of aluminum deposition. For example, aluminum undergoes chemical reactions with nickel and cobalt to form nickel aluminides and cobalt aluminides, respectively. Also, aluminides of substrate elements are similarly formed by chemical reaction; and the aluminide crystals grow together and form a bond with the substrate.

The resultant coating is dense and metallurgically bonded to the substrate by aluminides of substrate elements. It is free of elements which adversely effect oxidation and hot corrosion resistance and is rich in elements and aluminum intermetallic compounds or aluminides which have high resistance thereto.

A slurry as employed in the novel process just described will typically include one part by volume of powdered metallic elements capable of reacting with aluminum and an organic vehicle and a binder/suspending agent constituting, in total, 2.5–3.5 parts by volume. The ratio between the last-mentioned constituents and the metallic elements is not critical and can be changed depending upon the technique by which the composition is applied.

The powders used in the modifier may be elemental or prealloyed. Yttrium is always prealloyed with cobalt or nickel to minimize oxidation during handling. With that exception unalloyed powders are in general favored because they perform as well as and cost less than those which are prealloyed.

The modifiers we use are those having the following compositions:

| Metallic Element | Percent by Weight |
|---|---|
| Ni | 10 to 70 |
| Co | 10 to 70 |
| Cr | 5 to 20 |
| Y | 0 to 1 |
| Zr | 0 to 1 |
| Si | 0 to 1 |

One preferred group of modifiers is that in which the powdered metallic elements are:

| Element | Percent by Weight |
|---|---|
| Ni | 60 to 70 |
| Cr | 15 to 20 |
| Co | 10 to 20 |
| Si | 0 to 1 |

Other preferred combinations include those in which the powdered metallic elements are:

| Element | Percent by Weight |
|---|---|
| Co | 60 to 70 |
| Cr | 15 to 20 |
| Ni | 10 to 20 |

Dispersion of the powdered metallic elements in the organic vehicle can be readily accomplished in a blade or other high velocity blender or in a ball mill.

The particular organic vehicle and binder/suspending agent we employ are not critical, and many different materials have been used successfully. Typically, we will use xylene as the organic vehicle with 1.25 percent based on the weight of the vehicle of a low viscosity ethyl cellulose as a combination suspending agent and binder.

Among the many other organic vehicles that can be employed are the Acryloid resins and various lacquer thinners. Typical of other combination binders and suspending agents that we may employ are various polybutenes, nitrocellulose compositions, and a variety of petroleum waxes.

To minimize the formation of gases and solids in the decomposition of the binder/suspending agent during the aluminizing cycle, the amount employed in the slurry is maintained as low as possible without making it ineffective to hold the metal particles in place on the substrate surface after removal of the organic vehicle. In general the amount of binder/suspending agent should be about 1 to 10 percent by weight based on the total weight of the metal particles. The precise amount of the constituent depends on the material which is chosen and a number of auxiliary factors such as its effect on the viscosity of the vehicle and on the physical abuse to which the part will be subjected during processing.

The thickness to which the slurry is applied will depend upon the thickness of the ultimate corrosion resistant coating to be produced in accordance with the invention. Coatings thinner than 0.002 inch do not impart adequate corrosion resistance. Coatings between 0.002 and 0.007 inch appear to be optimum with the upper limit being based primarily on increasing sensitivity to thermal and mechanical shock rather than any decrease in corrosion resistance of the coating.

The amount of bisque required to achieve the ultimate coating thickness can be readily determined. In general there is an approximately 10 to 20 percent increase in thickness during the aluminizing cycle. Thus, a 0.004 inch thick bisque will typically expand to a 0.005 inch thick final coating; and bisques ranging in thickness from 0.002 to 0.005 inch will typically be employed to produce final coatings in the preferred range.

The aluminizing pack is applied in a conventional manner with the bisque completely surrounded by the pack. Close proximity of the bisque and the material in the pack is desirable so that the transport of metal vapors from the pack to the article will be rapid and uniform.

The pack can contact the bisque, but this is not a requisite to obtaining excellent coatings. Separation of the pack from the bisque results in a slower deposition rate, but the coating quality will remain high.

After the bisque coated artifacts are placed in the aluminizing pack, it is introduced into a retort. The retort is either: (1) cycle vacuum purged with argon or other inert gas being introduced after each evacuation; (2) purged directly with argon or inert gas; or (3) used without pre-purging. In the last case high volatility compounds can be added to purge air from the pack. These volatile compounds are added in quantities of less than 1 percent.

The composition of the aluminizing pack is not critical in the practice of the invention although a source of aluminum with a higher chemical activity than the aluminide to be formed must be used; and packs from which the aluminum will deposit slowly are preferred. For example, if a 15 percent aluminum coating is desired, the coating pack must have a chemical activity slightly greater than the equivalent of 15 percent aluminide. If the bisque is to be converted to $\beta$-NiAl or $\beta$-CoAl, the pack must have an aluminum activity greater than the activity in these two intermetallic compounds.

As such packs or aluminum sources are well-known in the industry and the patent literature, it is not considered necessary to discuss them in detail herein (see, for example, U.S. Pat. Nos. 3,257,230 issued June 21, 1966, to Wachtell; 3,290,126 issued Dec. 6, 1966, to Monson; 3,462,820 issued Aug. 26, 1969, to Maxwell et al.; and 3,647,517 issued Mar. 7, 1972, to Milidantri et al.).

Aluminizing packs we have employed successfully include those having the following compositions:

3–12 percent by weight aluminum

24–30 percent by weight chromium balance aluminum oxide plus a halide activator or chemical transfer agent (it is the function of this constituent to promote the transfer of aluminum, etc. from the pack to the bisque and superalloy substrate)

Halide activators we have successfully employed are: $3NaF{\cdot}AlF_3$, $NH_4Cl$, $NH_4F$, $NH_4Br$, $NH_4I$, NaCl, NaF, NaBr, and NaI. Up to one percent of halide activator can be used.

If pre-purging is not employed, a compound such as ammonium chloride, ammonium fluoride or ammonium iodide will typically be employed as the chemical transfer agent because of air purging effectiveness which compounds of this character have.

It is of course not necessary that the purging agent be an activator or transfer agent. Examples are sodium fluoride and sodium aluminum fluoride.

Aluminum-chromium-aluminum oxide packs are prefired at 2000° F. for 16 to 100 hours before use, and they can be used for extensive periods of time after the initial prefiring. The prefiring produces an alloy of aluminum and chromium and decreases the chemical activity of these elements and thus the rate at which they are deposited during the aluminizing cycle (this, as suggested above, is important to the formation of a high quality coating).

Typically, we employ a pack aluminizing cycle of 16 hours at 2000° F. for nickel-based modifiers and 16 hours at 2100° F. for cobalt-based modifiers. These temperatures and times can be varied depending on the thickness of the modifier and its composition. Thicker modifiers require longer cycles and thinner modifiers shorter cycles (all cycles refer to the time at temperature of the part within the pack).

In any event the cycle is continued until the aluminide coating has an aluminum concentration of from 22 to 33 percent by weight which requires that from 12 to 25 milligrams of aluminum per square centimeter of substrate surface be deposited on the article.

No special processing of the parts is necessary after the aluminizing cycle. Clean-up wire brushing or glass bead blasting may be employed, but this is not critical to performance of the coating.

In converting the modifier elements to $\beta$-aluminides by reaction sintering, a 130–150 percent expansion in the volume of the nickel and/or cobalt is experienced. This expansion minimizes voids in the coating.

Specifically, as applied, the modifier is only 40 to 60 percent of theoretical density. Essentially all of the voids are eliminated in the aluminizing cycle, densities of 90 percent (or higher) typically being reached.

The sintering reaction is also responsible for producing the bond between the coating and the substrate. The aluminizing cycle is continued until part of the aluminum penetrates completely through the modifier to the substrate. Elements in the substrate react with this aluminum to produce a strong metallurgical bond between the substrate and the coating.

The aluminum penetrates 0.00025 to 0.001 inch into the substrate to effect a satisfactory metallurigcal bond. The optimum range of thickness for the coating including the $\beta$-MAl formed with the substrate is 0.004 to 0.007 inch.

As an option, a slip containing aluminum oxide, an organic vehicle, and a suspending agent can be applied over the modifier prior to the aluminizing cycle. Some of this oxide actually penetrates into the modifier.

The aluminum oxide acts as a separating agent between the modifier and the aluminizing pack. It may also improve the performance of the ultimate coating.

Other oxides may be substituted for the aluminum oxide. these include magnesium, thorium, and hafnium oxides.

Mixed oxides may also be employed.

Because elements such as W, Mo, Ta, Ti, and Cb are excluded from the modifier composition, the aluminide coating formed in the pack process is essentially free of these elements and intermetallic compounds of the elements. The coating therefore contains only aluminides which are highly resistant to corrosion, oxidation, and sulfidation even at elevated temperature.

Another advantage of our process is that complex configurations can be readily coated. The techniques employed to apply the powder modifiers are adaptable to the most complex shapes as is pack aluminizing.

Also, the coating can be restricted to specified areas os the substrate in applications where this is necessary or desirable.

Another advantage of our invention is the high degree of control that can be exercised over the composition of the coating. This is important for obvious reasons.

A further important advantage of our process is its low cost. This will typically be, at most, not more than 50 percent greater than that of the inferior conventional pack cementation process but much less than Evans' electron beam deposited coatings.

From the foregoing it will be apparent that one important object of the invention resides in the provision of novel, improved superalloy articles which are hot corrosion resistant and are also resistant to oxidation and sulfidation.

A related and also important object of the invention resides in the provision of articles which have a superalloy substrate to which there is metallurgically bonded a coating containing at least one aluminum intermetallic compound or aluminide.

Another primary object of the invention resides in the provision of novel, improved processes for providing superalloy articles of the character described in the preceding objects.

Related and also important but more specific objects of the invention are the provision of methods for providing superalloys with coatings:

1. which are metallurgically bonded to the superalloy and which contain aluminum intermetallic compounds or aluminides;
2. which permit the coatings to be applied to complex shapes and to selected areas only of a substrate;
3. which are superior in performance to conventional aluminide coatings;
4. which are equal or superior to aluminide electron beam vaporization coatings and can be applied at only a small fraction of the cost of the latter;
5. which permit the composition of the coating to be closely controlled;
6. which have various combinations of the foregoing attributes.

Figure 2:
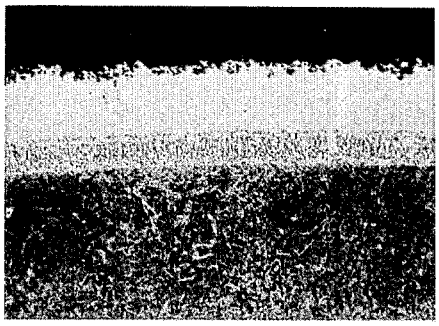
Figure 3:
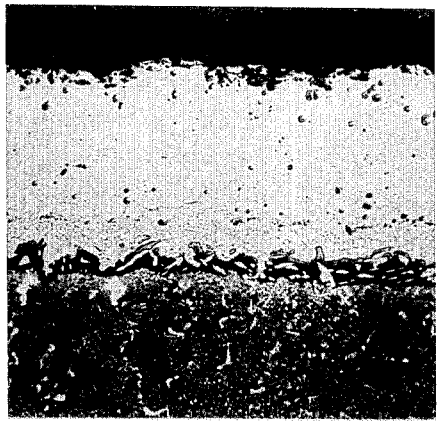
Figure 4:
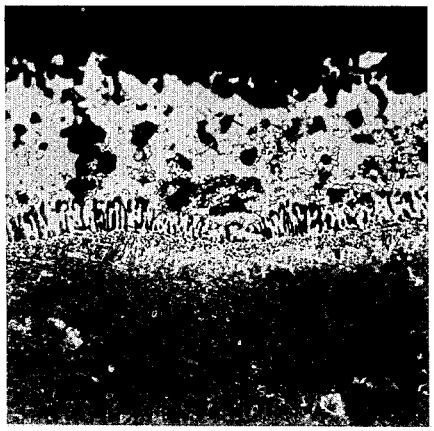
Figure 5:
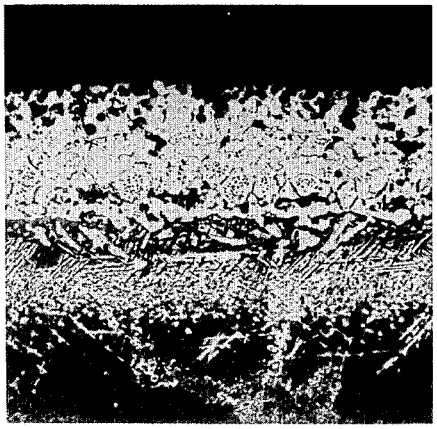

Other objects and advantages and further important features of the invention will become apparent from the appended claims, from the discussion and examples which follow, and from the accompanying drawing, in which:

FIG. 1 compares, graphically, the service lives of a representative superalloy, the superalloy with a conventionally applied diffusion coating, and the same superalloy protected against hot corrosion and other deleterious effects in accord with the principles of the present invention;

FIGS. 2 and 3 are 250× photomicrographs of the representative superalloy with, respectively, a conventional diffusion coating and a coating applied in accord with the principles of the present invention; and FIGS. 4 and 5 are 150× photomicrographs of coatings in accord with our invention which have been subjected to a 3,000 hour hot corrosion test.

The example which follows illustrates how superalloys can be protected with coatings including nickel-based modifiers in accord with the principles of the present invention.

EXAMPLE 1

An IN–713C nickel base superalloy was vapor degreased and lightly sandblasted with 80 to 120 grit aluminum oxide to clean its surface. The specimen was then coated with a slurry in which the particulate modifier was 69 percent by weight nickel, 15 percent by weight chromium, 15 percent by weight cobalt, and 1 percent by weight silicon. All particles in the modifier were −43 microns, and the modifier was dispersed in 2.5 parts by volume of xylene vehicle per one part by volume of modifier. The xylene vehicle contained 1.25 percent by weight of ethyl cellulose based on the weight of the xylene.

The coated article was air dried at a temperature in the preferred 70°–100°F range until the xylene evaporated and was then placed in an aluminizing pack containing 10 percent by weight aluminum, 25 percent by weight chromium, and 0.25 percent by weight ammonium chloride with the balance being alumina. The article and pack were sealed in a retort and argon flowed through the retort in an amount which was 10 times the volume of the retort. The retort was then heated at a temperature of 2000°F. for 16 hours.

At the end of this period the superalloy had a coating as herein described. It was taken out of the retort and cleaned.

The coating weighed 53 mg/cm². This was made up of 35 mg/cm² modifier elements plus 18 mg/cm² aluminum.

Tolerances within which the coating can be held will typically be ± 3 percent for the aluminum and ± 5 percent for the modifier elements.

The following example is illustrative of the formation of cobalt-based protective coatings in accord with the principles of the present invention.

EXAMPLE 2

The substrate and procedure described in the preceding example were employed. The modifier contained 65 percent by weight cobalt, 20 percent by weight nickel, and 15 percent by weight chromium; and a pack aluminizing temperature of 2100°F. was used for a 16 hour cycle.

The results in terms of coating weight, adherence, and high quality of the coating were essentially the same as obtained in the test described in Example 1.

Turning now to the drawing, FIG. 1 compares, graphically, the hot corrosion resistance of uncoated IN-713C and the same alloy with a commercial diffusion aluminide coating and with coatings provided as described generally above and then in more detail in Examples 1 and 2.

All specimens were subjected in a crucible maintained at a temperature of 1750°F. to a corrodent consisting of 95 percent sodium sulfate and 5 percent sodium chloride. As can be seen from FIG. 1, the uncoated alloy failed in 8 hours. The diffusion aluminide coated specimen failed in less than 22 hours whereas the specimen with our novel nickel- and cobalt-based coatings (cobalt-15 chromium-15 nickel and nickel-15 cobalt-15 chromium-1 silicon both aluminized in a chromium-aluminum pack) provided approximately 100 hours of protection.

Tests have also established that superalloys protected against deleterious effects by our novel process have service lives comparable to the same superalloys coated by the Evans et al electron beam deposition process.

In one such test, Ni-15Cr-15Co-1Si and Co-20Ni-15Cr modifiers aluminized in a Cr-Al pack were applied to IN-738 alloy. A tunnel rig fired with No. 2 diesel fuel (one percent sulfur) with 7 ppm in equivalent sodium added provided a severe, hot corrosion environment (a tunnel rig is a testing set-up capable of accurately simulating the conditions in a turbine engine combustion chamber). After 3000 hours at 1600°F. the substrate was undamaged. No conventional diffusion aluminide (e.g., that of Levinstein) withstood more than 500 hours of tunnel rig testing.

Referring again to the drawing, FIG. 2 shows the microstructure of a popular commercial diffusion aluminized coating; and FIG. 3 shows the microstructure of a Ni-15Cr-15Co-1Si aluminized modifier applied in accord with the principles of the present invention, a thin aluminum oxide layer having been applied to the modifier by spraying prior to the aluminizing cycle.

The microstructural differences are apparent and significant. The diffusion aluminized coating has a very high concentration of molybdenum, chromium, and other refractory metals at the coating and substrate interface. Also, some of the residual white phase in the coating is molybdenum. These phases decrease the resistance of the coating to hot corrosion and to shear fracture.

In contrast, the coating and substrate interface shown in FIG. 3 is so low in molybdenum and chromium that gamma nickel has formed. The light colored phases within the coating are free of molybdenum and are primarily alpha chromium which has only limited solubility in $\beta$-NiAl. The dark phases are residual aluminum oxide particles which penetrated the initial porous modifier prior to aluminizing.

FIGS. 4 and 5 are photomicrographs of specimens cut from the articles subjected to the 1,600° F., 3,000 hour, hot corrosion test described above. As can be seen by a comparison of FIGS. 4 and 5 with FIG. 3, there was little change in the coating after this very extensive test period.

The phases formed in the substrate at the interface are typical. They are caused by slow rejection of chromium from the coating and diffusion of nickel from the substrate into the coating.

The thicknesses of the coatings were essentially unchanged after this extended test period.

From the foregoing, it will be apparent to those skilled in the relevant arts that our invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A process for protecting a superalloy containing one or more elements which have an adverse effect on hot corrosion resistance thereagainst said process comprising: forming on a substrate of said superalloy a dense overlay which is rich in intermetallic compounds of aluminum and elements which are hot corrosion resistant, which is essentially free of substrate elements as aforesaid, and which is metallurgically bonded to the substrate by aluminides of substrate elements, the formation of said overlay being effected by: coating the substrate with a non-ferrous, aluminum-free modifier which contains, in particulate form:

| Element | Percent by Weight |
|---|---|
| Ni | 10–70 |
| Co | 10–70 |
| Cr | 5–20 |
| Y | 0–1 |
| Zr | 0–1 |
| Si | 0–1; |

and then aluminizing the coated substrate to produce a corrosion resistant overlay as aforesaid, said aluminizing being continued until the aluminum has penetrated through the coating and reacted with one or more substrate elements to form the metallurgical bond as aforesaid.

2. The process of claim 1, together with the step of applying a second, oxide containing coating to said superalloy substrate over the coating of the non-ferrous, aluminum-free modifier prior to aluminizing said substrate.

3. The process of claim 2, wherein the oxide is aluminum oxide.

4. The process of claim 1, wherein said aluminizing step is carried out by heating the coated substrate in the presence of aluminum at a temperature in the range of 2,000°–2,100° F. for a period of 6 to 40 hours.

5. The process of claim 1, wherein the aluminizing is continued until from 12 to 25 milligrams of aluminum per square centimeter of surface has been deposited on said superalloy substrate.

6. The process of claim 1, together with the step of sintering the coated superalloy substrate at a temperature between 1,800° and 2,100° F. prior to the aluminizing step.

7. The process of claim 6, wherein the sintering step is carried out in vacuo or in a protective gas atmosphere.

8. The process of claim 1, wherein the metallic particles applied to the substrate have a maximum size of 43 μm.

9. The process of claim 1, wherein the metallic particles are of the following composition:

| Element | Percent by Weight |
|---|---|
| Ni | 60–70 |
| Cr | 15–20 |
| Co | 10–20 |
| Si | 0–1. |

10. The process of claim 1, wherein the metallic particles are of the following composition:

| Element | Percent by Weight |
|---|---|
| Co | 60–70 |
| Cr | 15–20 |
| Ni | 10–20 |

11. The process of claim 1, wherein said metallic elements are alloyed prior to the step of coating the superalloy substrate.

12. A process for protecting a superalloy containing one or more elements which have an adverse effect on hot corrosion resistance thereagainst, said process comprising: forming on a substrate of said superalloy a dense overlay which is rich in intermetallic compounds of aluminum and elements which are hot corrosion resistant, which is essentially free of substrate elements as aforesaid, and which is metallurgically bonded to the substrate by aluminides of substrate elements, the formation of said overlay being effected by: coating the substrate with a slurry comprising a non-ferrous, aluminum-free modifier which contains, in particular form:

| Element | Percent by Weight |
|---|---|
| Ni | 10–70 |
| Co | 10–70 |
| Cr | 5–20 |
| Y | 0–1 |
| Zr | 0–1 |
| Si | 0–1; |

drying the coating; and then aluminizing the coated substrate to produce a corrosion resistant overlay as aforesaid, said aluminizing being continued until the aluminum has penetrated through the coating and reacted with one or more substrate elements to form the metallurgical bond as aforesaid.

13. The process of claim 12, wherein the slurry with which the superalloy substrate is coated includes, in addition to said metallic element or elements, a first constituent which is an organic vehicle and a second constituent capable of acting as a suspending agent for said metallic element or elements and as a binder for keeping the metallic element or elements in place on the substrate to which it is applied.

14. The process of claim 13, wherein said slurry contains a plurality of metallic elements as aforesaid and said second constituent constitutes between one and 10 percent based on the weight of the metallic elements.

15. The process of claim 14, wherein the ratio of the first and second constituents combined to the metallic elements is between 2.5:1 and 3.5:1 by volume.

16. The process of claim 14, wherein the first constituent is xylene and the second constituent is a low viscosity ethyl cellulose.

17. The process of claim 13, wherein said coating is applied in a thickness ranging from 0.002 to 0.005 inch.

18. The process of claim 13, wherein the coating applied to the superalloy substrate is dried at a temperature ranging from 70° to 100° F.

19. The process of claim 12, wherein there are a plurality of metallic elements as aforesaid and wherein said elements are cobalt and nickel.

20. A process for protecting a superalloy containing one or more elements which have an adverse effect on hot corrosion resistance thereagainst, said process comprising: forming on a substrate of said superalloy a dense overlay which is rich in intermetallic compounds of aluminum and elements which are hot corrosion resistant, which is essentially free of substrate elements as aforesaid, and which is metallurgically bonded to the substrate by aluminides of substrate elements, formation of said overlay being effected by: coating the substrate with a non-ferrous, aluminum-free modifier which contains, in particulate form:

| Element | Percent by Weight |
|---|---|
| Ni | 10–70 |
| Co | 10–70 |
| Cr | 5–20 |
| Y | 0–1 |
| Zr | 0–1 |
| Si | 0–1; |

and then reaction sintering the coated substrate in an aluminizing pack to produce a corrosion resistant overlay as aforesaid, said reaction sintering being continued until the aluminum has penetrated through the coating and reacted with one or more substrate elements to form the metallurgical bond as aforesaid.

21. The process of claim 20, wherein the aluminizing pack includes a halide activator in an amount of not more than one percent by weight and wherein the halide activator is selected from the group consisting of: $3NaF \cdot AlF_3$, $NH_4Cl$, $NH_4F$, $NH_4Br$, $NH_4I$, NaCl, NaF, NaBr, and NaI.

22. The process of claim 20, wherein the aluminizing pack contains chromium in addition to aluminum and wherein the aluminum and chromium are combined into an alloy prior to said aluminizing step.

23. The process of claim 20, wherein, prior to said aluminizing step, said aluminizing pack is preconditioned by heating it at a temperature of up to 2000° F. for a period of 16 to 100 hours to react the aluminum and chromium, thereby reducing the reactivity of these components and the rate at which aluminum will be deposited on the coated superalloy substrate.

24. The process of claim 20, together with the step of purging the pack prior to said aluminizing step to eliminate air therefrom.

* * * * *